United States Patent [19]

Hakansson

[11] Patent Number: 4,903,458

[45] Date of Patent: Feb. 27, 1990

[54] ARRANGEMENT FOR THE ATTACHMENT OF BENDABLE, ELONGATED OBJECTS, IN PARTICULAR SUCTION TUBES, ALONG THE SIDE OF A PACKING CONTAINER

[75] Inventor: Jan Håkansson, Eslöv, Sweden

[73] Assignee: AB Profor, Lund, Sweden

[21] Appl. No.: 232,236

[22] Filed: Aug. 15, 1988

[30] Foreign Application Priority Data

Sep. 4, 1987 [SE] Sweden ..... 8703437

[51] Int. Cl.[4] ..... B65B 61/00

[52] U.S. Cl. ..... 53/410; 53/412; 53/128; 156/443; 156/477.1

[58] Field of Search ..... 156/477.1, 478, 443; 53/410, 419, 416, 415, 414, 413, 412, 128, 137, 134, 135, 133, 129

[56] References Cited

U.S. PATENT DOCUMENTS

D. 296,664 7/1988 Hjalmarsson ..... D9/337
3,558,403 1/1971 Richie et al. ..... 156/478
4,535,584 8/1985 Tsubota ..... 53/128
4,584,819 4/1986 Hakansson ..... 53/410
4,668,327 5/1987 Voltmer et al. ..... 156/477.1

*Primary Examiner*—James F. Coan
*Attorney, Agent, or Firm*—Burns, Doane, Swecker & Mathis

[57] ABSTRACT

An apparatus for attaching drinking straws to a container includes a conveyor track for advancing containers and a rotating drum having a plurality of receiving areas located around its outer periphery for receiving the drinking straws. An applicator is provided for applying a bonding agent to the side wall of the containers. A device for transferring the drinking straws form the receiving areas on the drum to the side wall of the container after the bonding agent has been applied is also provided. After the drinking straws are attached to the side wall of the container, a device folds the drinking straws so that the drinking straw does not project beyond the edge of the container.

19 Claims, 4 Drawing Sheets

ARRANGEMENT FOR THE ATTACHMENT OF BENDABLE, ELONGATED OBJECTS, IN PARTICULAR SUCTION TUBES, ALONG THE SIDE OF A PACKING CONTAINER

FIELD OF THE INVENTION

The present invention relates to an arrangement for the attachment of bendable, elongated objects and more particularly to an arrangement for attaching suction tubes to the sides of packing containers. The arrangement includes a conveyor track for successive advancement of packing containers to an application position, a synchronously rotating or revolving drum which includes a number of receiving spaces for the elongated objects arranged around the periphery of the drum, an applicator for the application of a bonding agent to each of the packing containers, and means for the transfer of the objects from the drum to the packing containers.

BACKGROUND OF THE INVENTION

The attachment of elongated objects such as, for example, suction tubes, spoons etc., to the outside of packing containers has been known for a long time, but it has been a problem, especially where suction tubes are concerned, that the length of the suction tube must exceed substantially the height of the package. However, the space on the side of the package does not allow a suction tube longer than one that can be accommodated along the diagonal of the largest side of the package to be placed on the package. One solution to that problem involves the use of telescopically extendable suction tubes. That is to say, two tube sections that are inserted into one another when they are fixed to the package wall, but which can be telescopically extended in relation to one another during use so as to form an appreciably longer suction tube. Another solution involves the use of the flexible suction tubes which can be bent along a crimped portion and which are either bent to a Ushape or are folded in some other manner so that the bent suction tube can be accommodated on the side of the package.

For reasons of sanitation, the suction tubes attached to the packages are nearly always enclosed in a protective envelope of preferably plastic material. The suction tube is generally supplied in such a manner that the envelopes are connected to one another in a web containing a great number of suction tubes wrapped in their envelopes. The individual suction tubes are separated from this web together with their envelope by dividing the web through use of cuts in the sealing zones which are provided between the connected envelopes. Arrangements are known for attaching suction tubes wrapped in envelopes along the sides of packing containers. In one arrangement, a heat-activated bonding agent (so-called hot-melt) is applied to the package side prior to attaching the suction tube envelope along the areas where the suction tube envelope later is to be fixed.

It has been found, however, that the attachment of such wrapped suction tubes which are longer than the diagonal of the package side entails difficulties since the suction tube together with its envelope, aside from having to be fixed to the side of the packing container, must also be folded in a special configuration in order to fit on the side wall of the packing container. Directions concerning such an arrangement for the application of foldable suction tubes are provided by the present invention.

In the following the invention will be described with reference to the attached schematic drawing, wherein:

DETAILED DESCRIPTION OF THE PREFERRED EMBODIMENT

Figure 2:
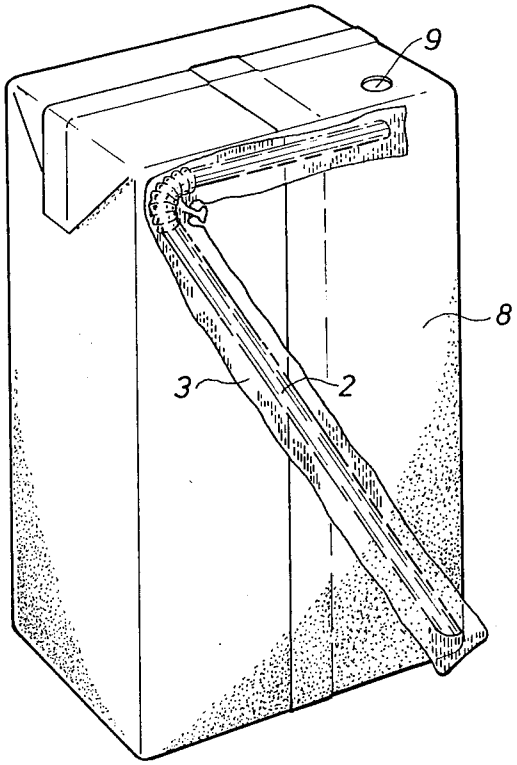
FIG. 2 is a perspective view of the finished package with a folded drinking straw affixed to it.
Figure 1:
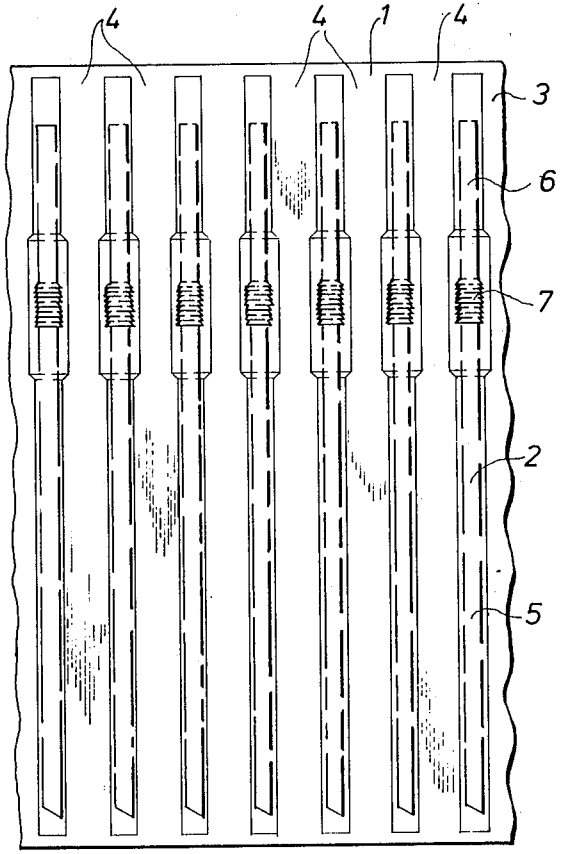
FIG. 1 is a top view of the band of envelopes containing the drinking straws which have a crimped portion.

FIG. 1 shows a band 1 of connected envelopes of thin plastic material with drinking tubes 2 located in the envelopes 3. The material of the envelopes 3 is sealed to itself in the areas 4 and the individual, wrapped drinking tubes 2 result when the band 1 is divided up through cuts in the sealing zones 4. The separated, individual drinking tubes 2 then will be wholly enclosed by their envelope 3. The drinking tubes consist of two straight parts 5, 6 and an intermediate crimped, bendable portion 7. As is evident from FIG. 2, it is intended that the drinking tube 2 with its envelope 3 will be affixed along the side wall of a packing container 8, and as is evident from FIG. 2, the contents of the packing container 8 can be made accessible by detaching the drinking tube 2 with its envelope 3 from the side wall of the package, whereafter the drinking tube 2 is freed of its envelope 3 and is inserted into a hole 9 provided in the packing container 8. The drinking tube 2 shown in FIG. 2 has a length adapted to fulfill the aforementioned purpose, but, as is evident from FIG. 2, the total length of the drinking tube 2 is such that the drinking tube cannot be accommodated along the side wall of the packing container 8 without being bent into a V-shape. The bending of the tube is carried out along a specially provided crimped portion 7 of the drinking tube 2. In addition to the crimped portion 7, the drinking tube, as mentioned earlier, has two straight parts 5, 6. The length of the part 5 substantially corresponds to, or is slightly less than, the diagonal length of the side wall of the packing container 8, whereas the shorter part 6 substantially corresponds to, or is slightly less than, the length of one of the lateral edges of the packing container 8.

One problem which arises in affixing the drinking tube 2 with its envelope 3 is that, not only must the drinking tube 2 be folded, but also the envelope 3 has to be bent or folded, and it has been found that stresses occur easily in the sealed portions of the envelope 3 along the outside of the curved part at the part of the envelope which is located close to the crimped portion 7. These stresses give rise to a certain deformation of the envelope 3 which may manifest itself in that the sealed edges of the envelope will stand out from the side wall of the packing container 8 instead of lying closely against the same. The reason why the side of the envelope 3 facing towards the packing container 8 must lie closely against the side wall of the packing container is that a larger contact surface will then be developed between the envelope 3 and the activated bonding agent applied previously to the side wall of the packing container 8 which promotes adhesion. Moreover, a projecting edge of the envelope 3 may easily cause the tube with its envelope to be torn off the package during transport and handling of the package.

Figure 3:
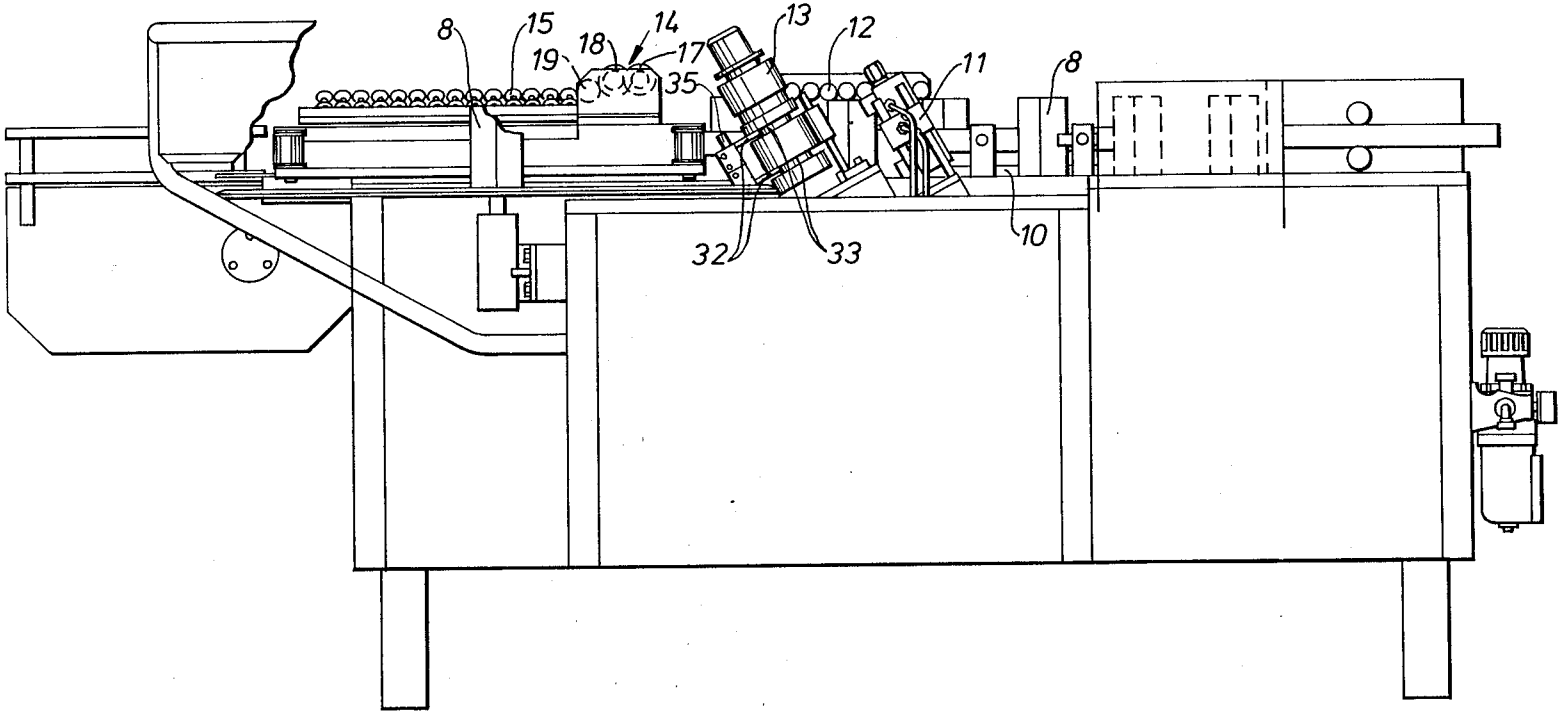
FIG. 3 is a side view of the apparatus used for applying the drinking straws to the containers.

The affixation of the drinking tube 2 can be carried out with the help of an apparatus of the type which is shown in FIG. 3. The apparatus shown in FIG. 3 includes a conveyor track 10 for advancing the packing containers 8 in a controlled manner to the position where bonding agent is applied and the drinking tubes 2 wrapped in the envelope are affixed. The conveying track 10 may be driven continuously or intermittently as a function of the rest of the design of the machine, and in the preferred embodiment the advance takes place intermittently. The packing containers 8, which are fed from a magazine or from a filling machine in operation, are gripped by drivers connected to the conveyor track 10 and are conducted past an applicator 11 for the application of activated bonding agent. In the present case, the bonding agent is a so-called hot-melt, which is a mixture of waxes and plastic compounds with good gluing capacity and a low melting point. Since the adhesive is solid and non-sticky at normal room temperature, it acts fast and provides a durable bond as soon as its temperature drops below approx. 50°–60° C. The bonding agent is extruded under pressure through dies (not shown) which are arranged in the applicator 11. The applicator 11 preferably includes two dies, one on a level just above the lower edge of the conveyor track 10, and one die on a level just below the top edge of the packing container 8. With the help of the dies, an appropriate amount of bonding agent is squirted onto the side of the packing container 8 along the area where the suction tube envelope 3 is meant to be attached. Since the dies are situated at different heights, the areas to which bonding agent is applied may be located at two levels relative to the bottom of the packing container 8. One of those areas having bonding agent deposited at the bottom part of the package near to its one corner, and two o more areas having bonding agent deposited at the upper side edge of the container 8. In order to maintain the containers 8 in their position in the conveyor track 10, rollers 12 or the like may be arranged on a level above the lower edge of the conveyor track corresponding to the height of the containers. Instead of rollers, an endless belt may be arranged above the conveyor track 10, the lower part of the belt being arranged on a level corresponding to the height of the packing containers 8. The drinking tubes 2, which are wrapped in their envelopes 3 in the manner mentioned before, are moved as a coherent band around a rotating drum 13 whose function will be described in more detail in the following with reference to FIG. 4.

With the help of separating means which cooperate with the drum 13, the individual drinking tubes 2 with their envelopes 3 are separated into individual units which are retained in spaces parallel with the axis of rotation of the drum and provided around the periphery of the drum. The drum 13 is adapted to revolve synchronously with the advancing of the conveying arrangement 10 so that a container 8 is situated with its side wall straight opposite the drum 13 when the still straight drinking tube retained by the drum is transferred from the drum 13 to the container 8. The transfer may be done in such a manner that movement towards the container is imparted to the drum and the revolving movement of the drum 13 is synchronized with the conveyor belt 10 so that the lower part 5 of the drinking tube 2 will be placed diagonally over the container 8 as it passes the drum 13 and so that the envelope enclosing the end parts of the tube part 5 will be brought into contact with the activated bonding agent applied earlier. In that way, the envelope 3 will be fixed to the bonding agent deposited on the container side.

In accordance with the design shown in FIG. 3, the drum is not movable to and from with respect to the conveyor track 10 and the containers 8 advanced in the conveyor track 10, but the drum is provided with transfer devices in the form of "fingers" 32 which press the drinking tube 2 with its envelope 3 out from the space in the drum 13. The envelope 3 with its drinking tube 2 is pressed firmly against the container 8 as it is advanced to a position in front of the drum 13. Further, the longer, straight tube part 5 is affixed with its envelope diagonally over the wall of the container 8. As is evident from FIG. 3, the drum 13 is placed obliquely in relation to the plane of transportation of the conveyor track 10, so as to allow the drinking tube to be affixed diagonally over the package side. The apparatus including a drum which is displaceable in relation to the containers 8 is used, as mentioned earlier, mainly in those applications where the containers 8 are advanced continuously by the conveyor track 10, whereas the apparatus with a stepwise revolving drum 13 and projectable fingers 32 is used in cases where the containers 8 are advanced stepwise by means of the conveyor track 10. After the lower straight tube part 5 has been affixed diagonally over the side surface of the packing container 8, the package is advanced further along the conveyor track and then comes into contact with a folding device 14, by means of which the projecting, straight part 6 of the drinking tube 2 is folded down to a substantially horizontal position, so that it will be located against the side surface of the packing container 8, while the envelope 3 is brought into contact with the activated bonding agent applied previously. In order to retain the folded-down tube part 6 in its position until the bonding agent has had time to stabilize itself, a series of rollers 15 is arranged in such a manner that they are pressed against the tube part 6 when the container is advanced. After passing the rollers 15, the drinking tube 2 is fixed to the container 8 in the desired manner and the container complete with the drinking tube can be carried away for packaging.

DESCRIPTION OF THE DRUM 13

Figure 4:
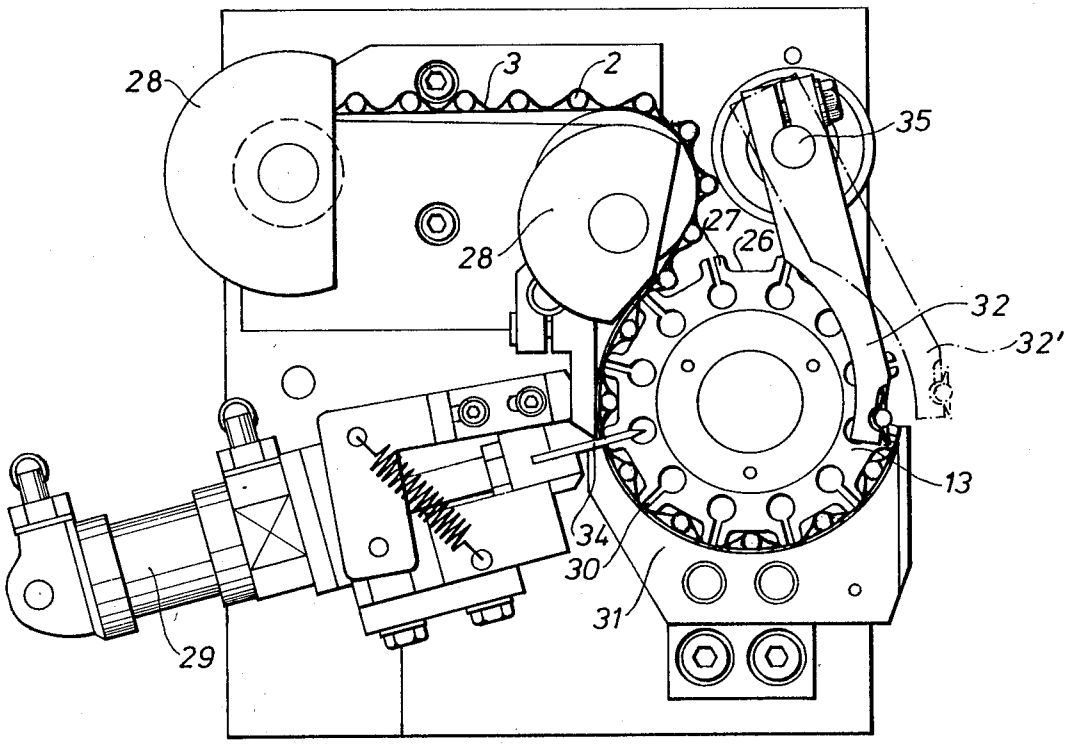
FIG. 4 is a cross-sectional view of the rotating drum used in the apparatus of the present invention.

The rotating drum 13 for attaching the drinking tube 2 is shown in FIG. 4 and in FIG. 3. As mentioned earlier, the drum 13 is adapted to rotate synchronously with the feed belt 10. This synchronization may be done mechanically, but preferably it also may be effected so that the revolving movement of the drum is controlled and initiated by a photocell (not shown) which senses the position of a packing container 8 advanced on the conveyor track. The photocell may be adapted so that it controls the applicator 11 as well as the drum 13 for the application of the drinking tube 2. The use of a photocell has the further advantage that the application of adhesive and the advance of new drinking tubes 2 will take place only when a package 8 is actually conveyed by the track 10, while a conveyor track which is "running idle" does not cause the bonding agent applicator 11 or the drum 13 to be activated. As is evident from FIG. 4, where the drum 13 is shown in cross-section, the drinking tubes 2 together with their envelopes 3 are accommodated in the spaces 26 arranged at a uniform pitch around the drum 13. The drinking tubes 2 are supplied to the drum 13 as a band in the manner described earlier. The band is passed over the supporting rollers 28 so that the band with its drinking tubes will spread itself evenly with one drinking tube per space, while the sealed portion of the envelopes 3 between the drinking tubes will be located at the raised portions 27 which delimit the spaces 26. The individual, wrapped drinking tubes 2 are separated from each other by the knife 34, which is controlled by the air cylinder 29 and which penetrates the space 30 provided between the projecting portions 27. By this action the sealed part of the envelope 3 is cut and a wrapped drinking tube 2 is separated from the band of drinking tubes. The separated drinking tube 2 cannot drop out of its space 26 though, since a catching arrangement or screen 31 is provided around parts of the circumference of the drum 13. The separated drinking tubes 2 consequently will be moved forwards in steps in their spaces 26 until they reach a position corresponding to the rear edge of the screen 31. In this position, the drinking tube 2 is straight in front of a container 8 advanced by the conveyor track 10 and the drinking tube 2 is transferred from the drum 13 to the container 8 with the help of an arm 32 which swings out and removes the suction tube from the space 26 and presses it against the container 8. In FIG. 4, the arm 32 is shown in a retracted position while the arm 32' is shown in an extended position when the drinking tube is being transferred. The arm 32 is adapted to be swivelled around an axis 35 whose operation likewise is controlled by the photocell which senses the position of a container 8 which has been advanced. As is evident from FIG. 3, the drum 13 is provided with recesses 33 in which the fingers 32 can move.

The drum 13 is adapted so that it readily can be exchanged to fit the drinking tubes of different diameter or different length, and the axle on which the drum 13 is mounted also can be adjusted so that its inclination relative to the horizontal plane is adapted according to the containers which are to be provided with the drinking tubes 2. In other words, the angle of inclination of the axle of the drum 13 with respect to the horizontal plane should preferably correspond to the angle of the diagonal between opposite corners of the packages 8 which are to be provided with the drinking tubes 2.

DESCRIPTION OF THE FOLDING-DOWN ARRANGEMENT 14

Figure 5:
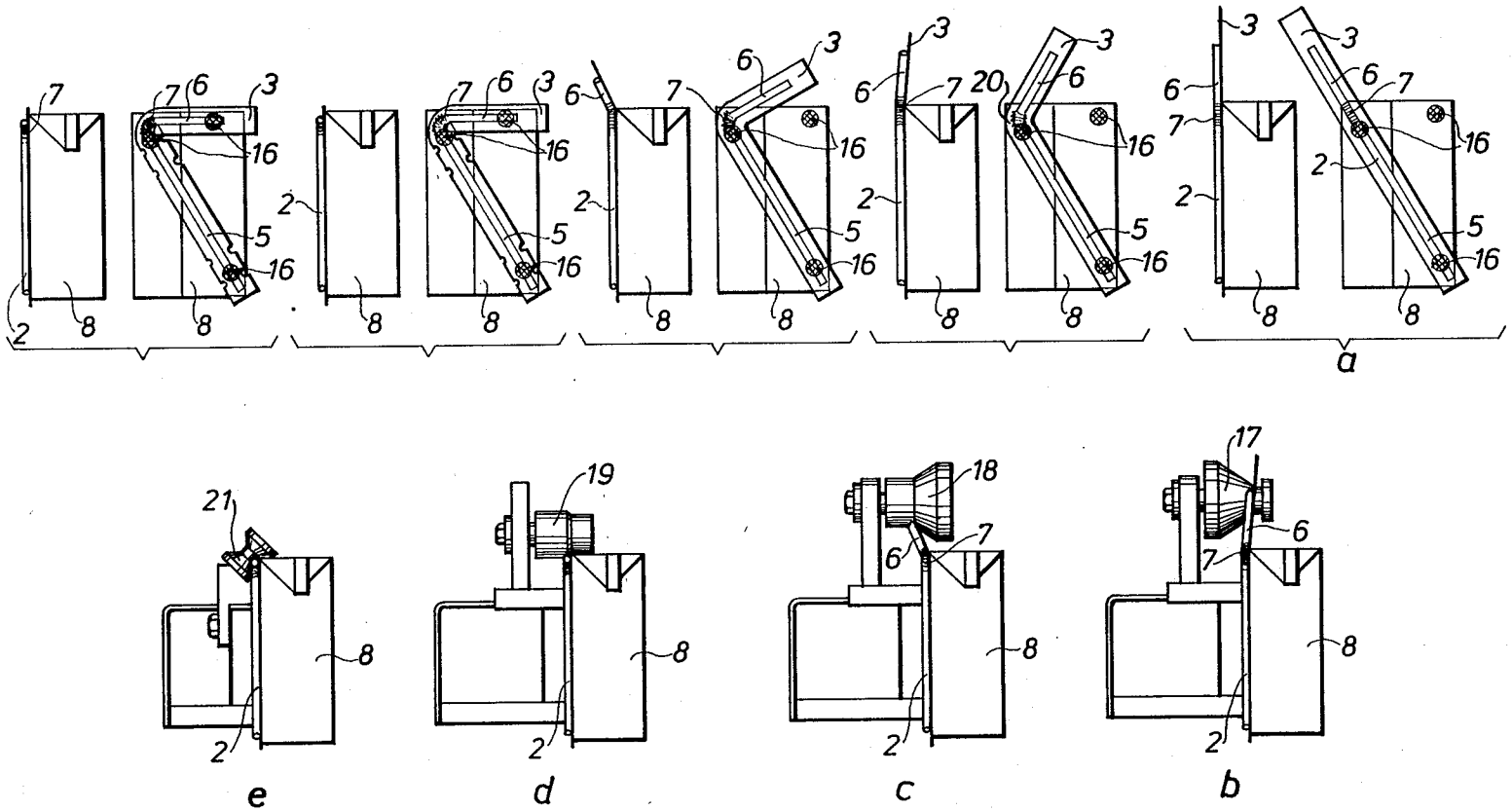
FIGS. 5*a*–5*e* are a sequential depiction of the steps involved in folding the drinking straw after it has been attached to the container.

After the container has passed the drum 13, the container 8 has the appearance according to FIG. 5*a* which shows the container from the side and from in front in the direction of the conveyor track. In the side view the applied bonding agent 16 is designated by round areas which, however, may also be more elongated areas. As is clearly evident from FIG. 5*a*, the tube part 5 is fixed to the side wall of the container 8, while the projecting tube part 6 is free and projects from the container 8. The folding-down arrangement 14 shown in FIG. 3 includes three rolls, namely the rolls 17, 18 and 19 which in FIGS. 5*b, c, d* are shown separately, but which in the apparatus arrangement are placed in relation to each other in the manner as shown in FIG. 3. The folding down of the projecting tube part 6 is initiated when the container 8 in its movement along the conveyor track 10 moves past the conical roll 17 (FIG. 5*b*). The projecting tube part 6 will then be folded backwards, the folding taking place along the crimped portion 7 of the drinking tube 2. Moreover, since the roll 17 is conical, the tube part 6 will be forced-in somewhat over the container 8 in the manner as shown in FIG. 5*b*. This means that at the folding point 20, the envelope 3 around the drinking tube 2 will be forced-in over the top corner point of the container. The lateral displacement of the tube part 6 helps ensure that the envelope 3 does not project from the container side, but will lie closely against the side wall of the container 8. A continued folding down of the tube part 6 takes place, as shown in FIG. 5*c*, by means of the conical roll 18, whose conicity is pointed in the direction opposite to the conicity of roller 17. This means that the tube part 6 will be displaced somewhat laterally away from the container 8 so as to make possible a complete folding down of the tube part 6 without any sealing edges projecting from the envelope 3 which might fasten onto the top part of the container 8. The final folding down of the tube part 6 is done with the help of the roller 19 which is shown in FIG. 5*d*. This roll is cylindrical and has a projection with a transition from a cylindrical surface of smaller diameter to a cylindrical surface of larger diameter. The cylindrical surface of smaller diameter is adapted to rest against the upper end surface of the container 8 whereas the part of the roller 19 with the larger diameter forces the suction tube part 6 down to the correct position wherein it lies closely against the side wall of the container 8, and where the envelope 3 around the tube part 6 is pressed against the bonding agent 16 applied previously, so that the envelope 3 is fixed to the side of the container 8. As shown in FIG. 5*e*, the tube part 6 is retained in its folded-down position with the help of a double-conical roller 21 until the bonding agent has become stabilized and the drinking tube 2 is firmly attached to the side wall of the container. In order to retain the part 5 of the drinking tube 2 attached first on the container 8 until the bonding agent 16 has had time to solidify and stabilize, the arrangement may be provided with lateral compression devices (not shown) which may be, for example, in the form of an endless pressure belt.

It has been found that the arrangement in accordance with the present invention functions with great certainty and that it is flexible in that it can be readily changed for applying different types of drinking tubes to containers of varying sizes.

While this invention has been illustrated an desoribed in accordance with a preferred embodiment, it is recognized that variations and changes may be made and equivalents employed herein without departing from the invention as set forth in the claims.

I claim:

1. A method for attaching elongated drinking straws wrapped in an envelope of flexible material to a side wall of a container through a heat-activated bonding agent, said drinking straws including a first portion, a second portion and a foldable portion connecting said first and second portions; the method comprising the steps of:

applying the bonding agent to a side wall of the container;

attaching the drinking straw to the side wall of the container by bringing the drinking straw wrapped in the envelope in contact with the bonding agent, said drinking straw wrapped in the envelope being attached to the container such that the first portion of the straw extends diagonally across the side wall of the container and the second portion of the straw projects beyond an edge of the container; and folding the second portion of the drinking straw wrapped in the envelope along the foldable portion by first folding said second portion in a direction towards the side wall of the container so that the second portion coincides with the side wall of the container and at least parts of the envelope are brought into contact with the bonding agent and thereafter folding said second portion in a direction away from the side wall of the container to thereby control the location of edges of the envelope to ensure that the second portion will be folded down without any portion of the envelope edges being secured to a top surface of the container.

2. A method in accordance with claim 1, further comprising the step of folding the second portion of the drinking straw in a direction parallel to the side wall of the container to thereby position the second portion wrapped in the envelope in its final position against the side wall of the container.

3. A method in accordance with claim 2 further comprising the step of retaining the second portion wrapped in the envelope in its final position until the bonding agent has stabilized.

4. An apparatus for attaching bendable, elongated drinking straws to a side wall of a container comprising:

a conveyor track for successively advancing containers;

a rotating drum that is rotatable about an axis of rotation, said drum having a plurality of receiving areas located around the outer periphery of the drum for receiving the bendable, elongated drinking straws, the axis of rotation of said drum being adapted to be substantially parallel to a diagonal line passing through opposite corners of the side wall of the container that is adapted to face the drum as the container advances along the conveyor track;

an applicator for applying a bonding agent to the side wall of each of the containers, said applicator including an upper applicator die and a lower applicator die located at different heights, said upper applicator die being adapted to deposit bonding agent at at least two separate areas on the side wall of the container adjacent an upper edge of the side wall, said lower applicator die being adapted to deposit bonding agent at a lower corner of the side wall of the container;

means for transferring the bendable, elongated drinking straws from the rotation drum to the side wall of the containers; and means for folding the bendable, elongated drinking straws after the bendable, elongated drinking straws have been attached to the side wall of the containers by the bonding agent.

5. An apparatus in accordance with claim 4, wherein said rotating drum includes a plurality of projections located around the outer periphery of the rotating drum, one pair of projections being positioned between adjacent receiving areas and each pair of projections being spaced apart by an opening.

6. An apparatus in accordance with claim 5, further comprising an air cylinder located adjacent the rotating drum, said air cylinder having a knife connected thereto that is adapted to penetrate the opening between pairs of projections on the rotating drum in response to operation of the air cylinder.

7. An apparatus in accordance with claim 4, further comprising means for retaining a folded part of the drinking straw in its folded position until the bonding agent has become stabilized.

8. An apparatus in accordance with claim 7, wherein said means for retaining a folded part of the drinking straw in the folded position comprises a double conical roller having opposed conical surfaces.

9. An apparatus in accordance with claim 4, wherein said means for folding and retaining the bendable, elongated drinking straws includes a plurality of rollers arranged in a series.

10. An apparatus in accordance with claim 4, wherein said means for folding and retaining said bendable, elongated drinking straws includes an endless band.

11. An apparatus in accordance with claim 4, wherein said applicator includes a heating chamber for heating heat-activated bonding agent, said applicator being adapted to extrude the heat-activated bonding agent under pressure and deposit the heat-activated bonding agent on the side wall of the container after the heat-activated bonding agent has been heated to a melting point in the heating chamber.

12. An apparatus in accordance with claim 4, further comprising means for maintaining the containers in the conveyor track, said means for maintaining the containers in the conveyor track being positioned above the conveyor track at a height that is adapted to correspond to the height of the container.

13. An apparatus inaccordance with claim 12, wherein said means for maintaining the containers in the conveyor track comprises a plurality of rollers arranged in a roller track.

14. An apparatus in accordance with claim 12, wherein said means for maintaining the containers in the conveyor track comprises an endless belt.

15. An apparatus in accordance with claim 4, wherein each of the bendable, elongated drinking straws that is adapted to be attached to the side wall of the container includes a drinking straw having a crimped portion that permits the drinking straw to be bent without later restricting the flow of liquid through the drinking straw.

16. An apparatus in accordance with claim 15, wherein each of the bendable, elongated drinking straws that is adapted to be attached to the side wall of the container is surrounded by an envelope of protective plastic material, the envelopes being connected to one another in a series, the drinking straws being arranged substantially parallel to one another at substantially equally spaced distances.

17. An apparatus in accordance with claim 4, wherein said means for folding the drinking straws comprises at least two conical rollers arranged in series, the conical surface of one of the conical rollers being arranged in a direction opposite to the conical surface of the other one of the conical rollers.

18. An apparatus in accordance with claim 17, wherein said means for folding the bendable, elongated drinking straw further includes a roller having a cylindrical portion of one diameter and another cylindrical portion of a smaller diameter.

19. An apparatus in accordance with claim 4, wherein said means for transferring the bendable, elongated drinking straw from the rotating drum to the side wall of the container comprises a retractable arm associated with said rotation drum and rotatable about an axis.

* * * * *